US006283749B1

(12) United States Patent
Bernard, Jr. et al.

(10) Patent No.: US 6,283,749 B1
(45) Date of Patent: Sep. 4, 2001

(54) INSIDE/OUT, INDUSTRIAL VACUUM FURNACE

(75) Inventors: William J. Bernard, Jr., Perrysburg; Thomas J. Schultz, Maumee, both of OH (US)

(73) Assignee: Surface Combustion, Inc., Maumee, OH (US)

( * ) Notice: Subject to any disclaimer, the term of this patent is extended or adjusted under 35 U.S.C. 154(b) by 0 days.

(21) Appl. No.: 09/584,981

(22) Filed: Jun. 2, 2000

(51) Int. Cl.[7] ..... F27D 1/18; F27B 5/04
(52) U.S. Cl. ..... 432/242; 432/205; 373/112
(58) Field of Search ..... 432/112, 114, 432/175, 184, 209, 242, 205; 373/71, 77, 95, 112, 122, 141, 155, 163, 164

(56) References Cited

U.S. PATENT DOCUMENTS 4,787,844 * 11/1988 Hemsath ..... 432/205
4,963,091 10/1990 Hoetzl et al. .
5,074,782 12/1991 Hoetzl et al. .
5,119,395 * 6/1992 Hemsath et al. ..... 373/112
5,127,827 * 7/1992 Hoetzl et al. ..... 432/175
5,224,857 7/1993 Schultz et al. .
5,261,976 11/1993 Schultz .
5,478,985 12/1995 Hoetzl et al. .

* cited by examiner

*Primary Examiner*—Gregory Wilson
(74) *Attorney, Agent, or Firm*—Frank J. Nawalanic

(57) ABSTRACT

A hot walled, industrial, batch-type vacuum furnace constructed with a cylindrical furnace casing having a closed spherical end and an open end adapted to be closed by a sealable door. Furnace insulation is applied to the outside of the door and furnace casing so that the inside of the furnace is impervious to the furnace gases. Special mounting arrangements are used to seal furnace components extending into the casing as well as the door by elastomer seals which are air cooled.

15 Claims, 12 Drawing Sheets

INSIDE/OUT, INDUSTRIAL VACUUM FURNACE

This invention relates generally to industrial heating furnaces and more particularly to industrial heat treat furnaces of the vacuum type.

This invention is particularly applicable to and will be described with specific reference to low temperature, vacuum furnaces of the "hot wall" type which include furnaces commonly known as draw or temper furnaces. However, it will be appreciated by those skilled in the art that the invention has broader application and may be applied to high temperature, hot wall vacuum furnaces.

INCORPORATION BY REFERENCE

The following patents are incorporated herein by reference and made a part hereof:

U.S. Pat. No. 4,963,091, Issued Oct. 16, 1990 to Hoetzl et al., entitled "METHOD AND APPARATUS FOR EFFECTING CONVECTIVE HEAT TRANSFER IN A CYLINDRICAL INDUSTRIAL HEAT TREAT FURNACE" including related U.S. Pat. No. 5,074,782, Issued Dec. 24, 1991;

U.S. Pat. No. 5,224,857, Issued Jul. 6, 1993 to Schultz et al., entitled "RADIANT TUBE ARRANGEMENT FOR HIGH TEMPERATURE, INDUSTRIAL HEAT TREAT FURNACE";

U.S. Pat. No. 5,261,976, Issued Nov. 16, 1993 to Schultz, entitled "CONTROL SYSTEM FOR A SOFT VACUUM FURNACE"; and, U.S. Pat. No. 5,478,985, Issued Dec. 26, 1995 to Hoetzl et al., entitled "HEAT TREAT FURNACE WITH MULTI-BAR HIGH CONVECTIVE GAS QUENCH".

The patents are incorporated as background material so that the description of the invention herein need not define what is conventionally known in the art. The background patents do not form part of the present invention.

BACKGROUND

Batch type industrial heat treat furnaces may be generally defined as either i) positive pressure furnaces which operate at about standard atmospheric pressure and are generally box shaped or ii) vacuum furnaces (which includes plasma or ion furnaces) which heat the work under a vacuum and are generally cylindrical pressure vessels employing a double wall vacuum tight casing defining a cooling water jacket therebetween. In both furnace types, a sealable door is provided for access to the furnace chamber to load batches of work onto a hearth. The work is heated, and a furnace atmosphere treating gas is introduced (during or after heating) and the work is cooled in a specified manner or cycle to effect a desired heat treatment. Certain heat treatment processes dictate use of a vacuum during some period of the cycle. As used herein, "vacuum furnace" means a furnace that pulls a vacuum in the furnace chamber during any portion of a heat treat cycle. For example, if a vacuum is used only to purge the furnace chamber prior to performing a heating and cooling heat treat process at positive pressure, the furnace is a vacuum furnace.

Positive pressure furnaces are less costly than vacuum furnaces primarily because only one furnace casing, which does not have to be welded vacuum tight is provided. Typically, the box furnace is lined with insulation on its inside so that the insulation is at furnace temperature while the casing exposed to ambient atmosphere, is at a far lesser temperature, but typically higher than ambient, hence its designation as a "hot wall" furnace. Providing the casing on the outside allows door sealing to be readily achieved between door flange and casing. However, the hearth sits on supports anchored to the casing and undergoes differential thermal expansion requiring an expansion joint construction. The assignee has sold a box type, positive pressure furnace in which the furnace insulation was applied to the outside of the casing. This allows for an integral hearth construction but resulted in door sealing concerns at the operating temperatures of the furnace which are best addressed by the provisions of a water cooled seal such as disclosed in the '857 patent for the radiant tube illustrated therein.

There are furnace applications where a portion of the heat process, such as tempering or work cleaning, is economically justified on a throughput basis, to be performed in a separate low cost furnace. These tempering or draw furnaces, which are low cost intensely cost competitive furnaces, are typically positive pressure furnaces using convective heat transfer to rapidly heat the work by circulating the furnace wind mass vis-s-vis movable or stationary baffles or damper arrangements. The assignee that such arrangements were unwieldy and introduced a cylindrical furnace under its UniDraw® brand name disclosed in the '091 patent to produce a wind mass pattern which heated the work at significantly better temperature uniformities than previously achieved.

Subsequently, the assignee determined that the single, cylindrical casing of the Uni-Draw furnace can be welded vacuum tight and the furnace functions as a vacuum furnace. As noted in the '976 patent, there are several heat treat processes which do not require high vacuum (low pressure) levels typically pulled by conventional, double walled, water jacketed vacuum furnaces. At these "soft" vacuum levels, the Uni-Draw furnace, modified to produce different wind mass patterns, special provisions for quenching and a single, vacuum tight casing as explained in the '782 and '985 patents (and marketed by assignee under its VacuDraw® brand name) has successfully functioned as a "hot wall" vacuum furnace.

The construction of the VacuDraw furnace is conventional in that a furnace casing is provided and batts or mats of furnace insulation are applied to the interior of the casing which is vacuum tight. A metal skin (oven panel) may optionally be applied to the exposed inner surface of the insulation or alternatively, a silicate rigidizer, i.e., Kaowool rigidizer, may be sprayed over the exposed surface of the fibre ceramic insulation. The thickness of the insulation determines the temperature of the furnace casing. Thus, the furnace casing does not significantly undergo thermal expansion and contraction and conventional elastomer sealing arrangements can be used for vacuum sealing the furnace door furnace "components" entering into the furnace chamber from the outside of the furnace without the need for water jacket cooling.

In the low temperature ranges of the temper or draw furnaces, the assignee has discovered that a VacuDraw furnace has a particularly useful advantage by initially pumping out the atmosphere in the furnace before introducing the treating gas to avoid purging the furnace with an inert atmosphere. After the vacuum is drawn the treatment gas is backfilled to place the furnace chamber at positive pressure so that convective heating of the work can occur. The cycle time is significantly decreased and the costs are reduced by eliminating the expense of an inert purge gas with an inexpensive furnace. In certain applications, the furnace is pumped down after heating with the work hot and the furnace atmosphere changed. However, it is believed that not all the elements of the furnace atmosphere are drawn out by the soft vacuum. Certain gaseous compounds can migrate into the furnace insulation before or during heating and become trapped. On cool down or heat up, the gases form undesirable compounds or contaminates which could effect the process, i.e., water vapor or oils from dirty parts.

SUMMARY OF THE INVENTION

Accordingly, it is a principal object of the invention to provide a "hot wall" vacuum furnace construction for use in low temperature convection heating applications which prevents any contaminants being absorbed by and subsequently released from the furnace insulation without the need for water cooling the furnace seals.

This object along with other features of the invention is achieved in an industrial batch, vacuum furnace having a furnace chamber defined by a furnace casing, a sealable door for loading work into and out of the furnace chamber, a fan extending through the casing for circulating furnace atmosphere within the chamber during a heat cycle, a heating mechanism within the chamber for heating the work within the chamber and ports within the casing for drawing a vacuum within the chamber and admitting a heat treat atmosphere to the chamber. The furnace construction includes furnace insulation applied to the outside surface of the furnace casing while the inside surface of the casing defines the surface of the furnace chamber and is exposed to the furnace atmosphere so that the furnace chamber is impervious to atmospheric gases and substances within the furnace chamber.

In accordance with another aspect of the invention, the furnace casing is suspended at its side by brackets to a support frame work in turn secured to the ground. The brackets are secured to the framework on a line approximately parallel with the longitudinal centerline of the casing whereby the casing can freely expand and contract in response to temperature changes within the furnace without incurring thermal distortion. In accordance with this aspect of the invention the furnace casing is cylindrical and has an open door end and an opposite closed spherical end.

In accordance with another aspect of the invention, the door used for the higher temperature range of the low temperature vacuum furnace has a dished in, concave configuration defined by a circular door section having at its circumference a cylindrical section. An annular door sealing flange extends radially outward from the end of the cylindrical door plane which is adapted to contact a resilient, elastomer seal. The circular and cylindrical door plate sections have outer surfaces facing the furnace casing and inner surfaces having furnace insulation attached so that when the door is closed, the circular and cylindrical door sections are within the furnace chamber closely circumscribed by the furnace casing to produce an impervious surface to the furnace atmosphere while also providing a sufficiently long heat path to maintain the door sealing flange relatively cool by exposure to ambient air.

In accordance with a still further aspect of the invention, the furnace casing has at its open end, a first annular sealing casing flange extending radially outwardly and in confronting relationship to the door sealing flange. A second radially outward casing flange is welded at one side to the upper portion of the first casing flange. Similarly, the door sealing flange has a second annular flange secured on one side of the uppermost portion of the door sealing flange. One of the second door or casing sealing flanges has an annular groove for receiving the elastomer seal which is compressed by the confronting surfaces of the second annular door seal and the second annular casing seal when the door is locked. By splitting the annular sealing flanges of the door and casing into offset flanges connected by a welded joint, the resistance to heat conduction through the sealing flanges is increased resulting in a lowered temperature of the flanges at sealing contact to permit use of an air cooled elastomer seal.

In accordance with another aspect of the invention, the door has a pivot arm with a series of first pivot points attached to the door and a second pivot attached to the framework whereby the door is fixed relative to the ground while it rotates and axially moves into and out of engagement with the open end of the furnace chamber so that the furnace casing resting at its longitudinal center supports may thermally expand and contract without binding the door or the door operating mechanism. Importantly, the door pivot arms are pivoted at the center of the door which is aligned with the longitudinal centerline of the furnace (about which the furnace casing thermally expands and contracts) so that the furnace and door tend to thermally expand and contract together as a unit.

In accordance with another aspect of the invention, the furnace casing has at least one opening. A projection contiguous with the casing is vacuum welded about the one opening and extends from the opening past the insulation for some distance whereat the projection has a projection flange formed at its end outside the furnace casing's insulation. An external furnace component which is to be inserted into the furnace chamber and connected to a supply source outside the furnace has a component sealing flange welded vacuum tight thereto. The furnace component is inserted through the projection and is sealing secured to the projection flange by its component flange outside and away from the furnace casing so that elastomers, cooled by atmospheric air, may be used to vacuum seal the insertion object without furnace heat adversely affecting the seal. The furnace components include the furnace fan assembly, vacuum and gas ports and radiant tubes, whether heated by gas or electric heating elements. In particular, the radiant tubes may be double ended and secured to a flanged bulkhead whereby differential thermal expansion of the tube legs is adsorbed by tube deformation. Alternatively, the radiant tubes can be single ended.

In accordance with still another aspect of the invention, the furnace component is a cooling tube comprising a coiled tube containing a coolant within a pipe threadingly connected to a coolant supply and extending into the furnace chamber. The projection in this instance has an outer tubular plate vacuum sealed to an opening in the furnace casing at the closed end of the furnace chamber and a concentric, radially inward, tubular plate extending within the insulation and secured to the outer plate with insulation therebetween. An insulating tube containing and sealed to the pipe outside the furnace chamber extends within the projection's inner tubular plate. A clamp secures the projection's outer tubular plate to the insulating tube outside the furnace whereby a heat sink extending within the furnace chamber is double insulated to prevent the casing from being subjected to thermal shock while utilizing an air cooled, elastomer seal.

It is a general object of the invention to provide an inside/out furnace casing/insulation construction for a cylindrical, industrial grade vacuum furnace.

It is another object of the invention to provide a low temperature vacuum furnace formed from a single casing such that the furnace atmosphere is exposed to the gas impervious casing.

It is yet another object of the invention to provide a door seal for a single casing, hot wall industrial vacuum furnace which is not water cooled.

It is another object of the invention to provide a hot wall industrial vacuum furnace in which all or most of the furnace components inserted into the furnace chamber are vacuum sealed without use of a water jacket.

It is still another object of the invention to provide a low cost industrial vacuum furnace in which the furnace casing is exposed to the furnace atmosphere and insulation applied outside the casing.

Still another object of the invention is the provision of a "hot wall" low temperature vacuum furnace utilizing an inside/out construction which is better able to achieve certain heat and heat treating processes than otherwise possible.

Yet another object of the invention is to provide an inside/out furnace construction so that the interior of the furnace chamber can be easily maintained in a clean state.

Still another object of the invention is to provide a single casing, vacuum furnace which has low maintenance and/or is less costly to operate than conventional furnaces.

These and other objects and advantages of the invention will become apparent from a reading of the Detailed Description section below taken together with the drawings which will be described in the next section.

BRIEF DESCRIPTION OF THE DRAWINGS

The invention may take physical form in certain parts and an arrangement of parts, a preferred embodiment of which will be described in detail and illustrated in the accompanying drawings which form a part hereof and wherein.

DETAILED DESCRIPTION OF THE INVENTION

Figure 1:
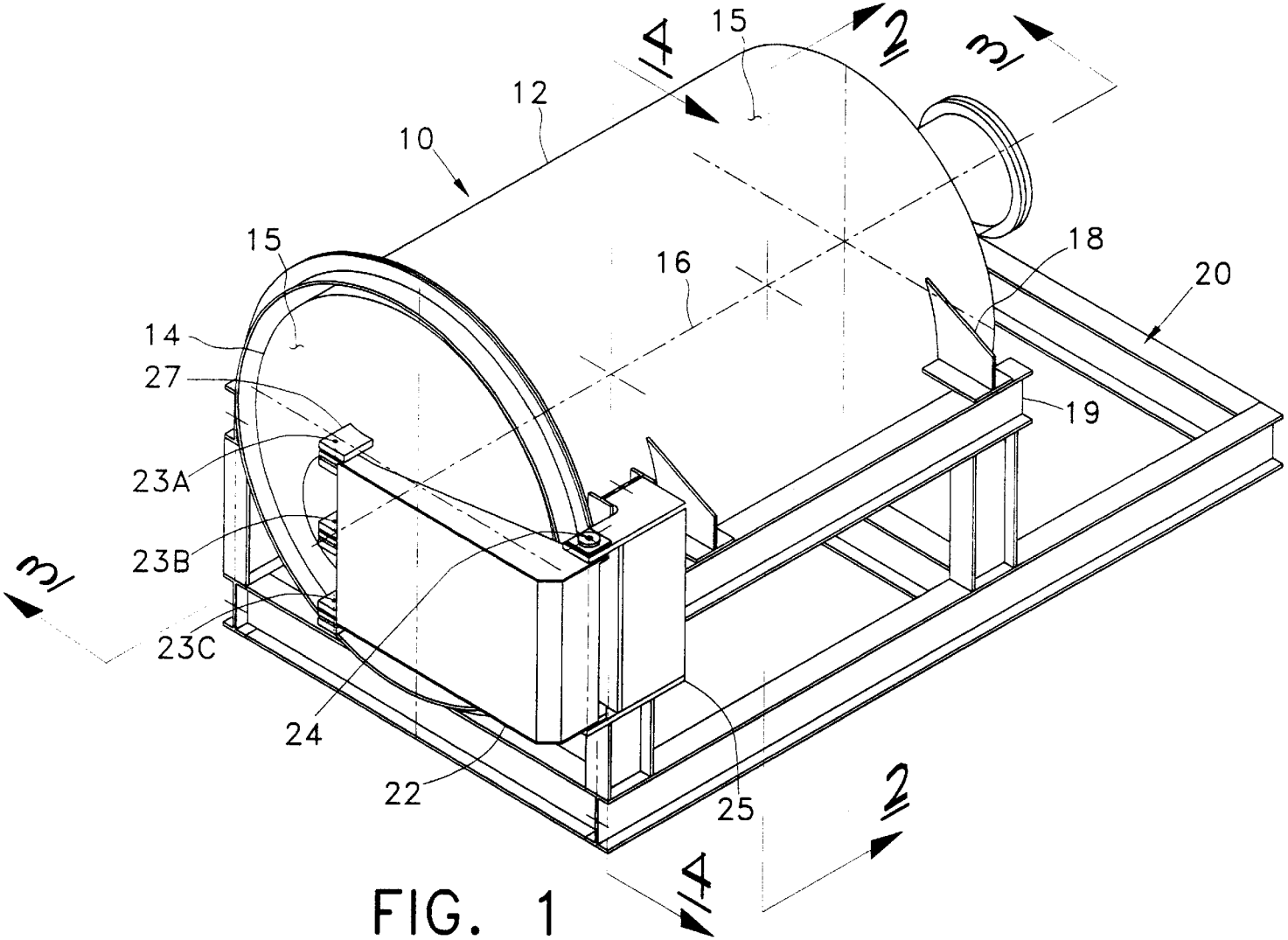
FIG. 1 is a perspective view of the furnace of the subject invention.

Referring now to the drawings wherein the showings are for the purpose of illustrating a preferred embodiment of the invention only and not for the purpose of eliminating same, there is shown in perspective view in FIG. 1 a vacuum furnace 10 of the present invention. Vacuum furnace 10 is essentially a cylinder 12 open at one end for loading and unloading work. The open end is adapted to be sealed closed by a door 14. The outer surface of cylinder 12 and door 14 is covered by a thin, 14 gauge steel cladding 15 which is not technically necessary but provided to protect the insulation from the elements.

Furnace 10 is symmetrical about longitudinal centerline 16 and is supported, more accurately, suspended, on each side by a pair of diametrically opposed support brackets 18. The base of support brackets 18 rest on an I-beam 19, in turn, secured to a foundation which, in turn, rests on or is secured to ground. The base of support brackets 18, or alternatively, the upper surface of I-beam 19 defines a plane or a line which is parallel or co-planar with furnace longitudinally extending centerline 16. That is, support brackets 18 support cylinder 12 at diametrically opposite positions which lie on an axis co-planar with longitudinal centerline 16. In conventional furnaces, outer cladding 15 is the furnace casing which, theoretically, is at ambient temperature and the furnace support for such conventional furnaces is typically to provide a crescent or moon shaped support affixed to a foundation at the bottom of the furnace. This is perfectly acceptable since the outer steel furnace liner in a conventional (hot wall) furnace does not undergo significant thermal expansion or contraction. However, the conventional support is not acceptable with the present invention. If the weight of the furnace rested on bottom supports, cylinder 12 would not be free to thermally expand or contract, i.e., the bottom portion of the cylinder would be constrained. Unacceptable thermal stresses within the furnace casing would result. Support brackets 18 positioned at the center of furnace 10 allow the furnace to thermally expand and contract freely without incurring additional stresses. Bottom "supports" could be used in an alternative embodiment of the invention, provided there was some clearance with cylinder 12 at "ambient" temperature to allow for thermal expansion and contraction.

Door 14 is supported by a door arm 22 which, in turn, is pivotably mounted to door 14 at one end by a series of first pivots 23 formed in first pivot arms 27 secured to door 14, there being three vertically spaced first pivots 23 designated 23A, 23B and 23C in the preferred embodiment. At its other end, door arm 22 is pivotably mounted through a second pivot 24 on a door support column 25 which, in turn, is secured to support foundation 20. The length of first pivot arms 27 is established at a distance sufficient to allow door 14 to longitudinally move into and out of cylinder 12 while door 14 is rotated about second pivot 24. Door pivot arrangement as described is conventional. However, in the conventional arrangement second pivot 24 is secured or integrally formed as part of furnace 10. In the present invention, door 14 and its support, i.e., door arm 22 is a separate stand alone item which allows door opening, closing and sealing notwithstanding differential thermal expansions contractions which occur between door 14 and cylinder 12. At the same time it should be noted that pivots 23A, 23B and 23C lie on an axis which intersects longitudinal axis 16. This support geometry expanding and contracting as a unit while fixing both units separately to ground allows differential thermal expansion to occur without binding.

Referring now to FIGS. 2, 3, 4 and 5, cylinder 12 comprises a cylindrical furnace casing 30 which is closed at its rear end by a dished or spherical end plate portion 31 and defines furnace chamber 32 contained therein. In the preferred embodiment, furnace casing 30 is A-36 or 304 stainless steel (depending on temperature) rolled to a set inside diameter and welded vacuum tight and spherical end plate portion 31 is also A-36 or 304 stainless steel (depending on temperature) of the same thickness similarly rolled and welded vacuum tight to furnace casing 30. The inside surface of furnace casing 30 defines the furnace chamber and determines the size of the furnace for processing work. On the outside surface of furnace casing 30 is conventional furnace insulation 34 secured to furnace casing 30 in a conventional manner. In the preferred low temperature embodiment of the invention, insulation 34 is flexible mineral wool applied as insulation batts and insulation blankets to furnace casing 30 and held in place by conventional studs/clips secured to furnace casing 30 and/or cladding 15. It is, of course, appreciated that the invention is not limited to any specific type of conventional furnace insulation and high temperature applications of the invention would require fibrous ceramic type insulation. However, for the low temperature applications of the preferred embodiment, inexpensive mineral wool insulation is acceptable.

As is known, the size or the capacity of the furnace is determined by its inside diameter. A conventional furnace with its furnace casing on the outside having the same capacity as the furnace of the present invention, must have a larger diameter furnace casing than furnace casing 30. Furnace casing is a major cost item of furnace 10 and keeping its size to a minimum for a given size furnace can significantly decrease the cost of the furnace. More subtly, the price of the insulation is affected. That is, the thickness of mineral wool insulation is not a significant factor in the cost of furnace 10 of the present invention. However, because the inside insulation diameter in a conventional furnace determines the capacity of the furnace, its thickness is minimized to keep the size of the conventional outside furnace casing at a minimum diameter. Thus, depending on price considerations, a more dense and expensive insulation, such as a ceramic fibrous insulation, may be used in a conventional hot walled furnace. Still further, since insulation 34, being mineral wool, is not a significant cost factor for the furnace, more insulation can be added to the furnace of the present invention with an accompanying decrease in heat loss from the furnace. In the preferred embodiment, the thickness of furnace casing 30 (and its spherical end plate portion 31) is about "⅜" which is typical.

Figure 2:
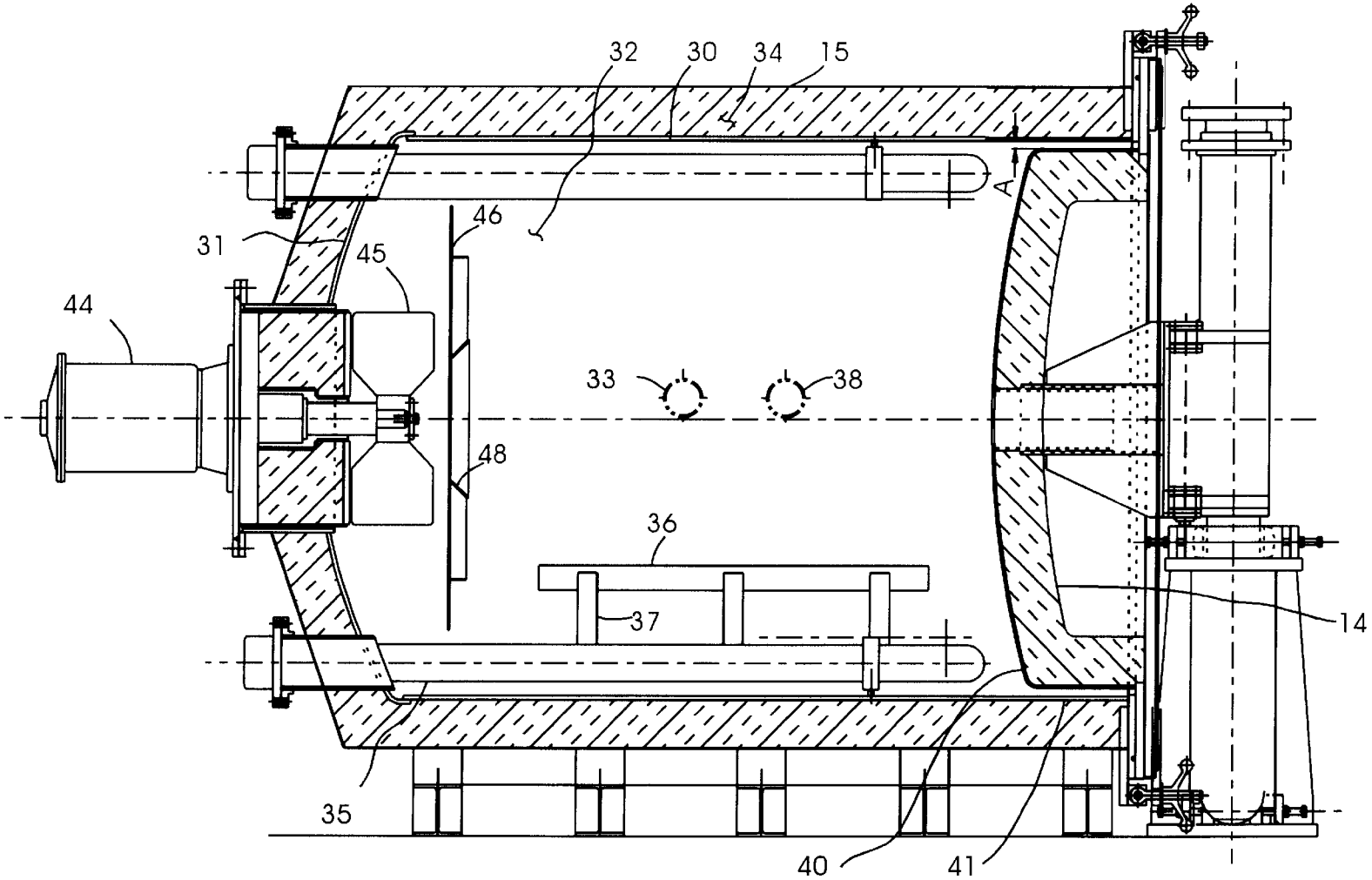
FIG. 2 is a sectioned elevation view of the furnace taken along lines 2—2 of the furnace shown in FIG. 1.
Figure 4:
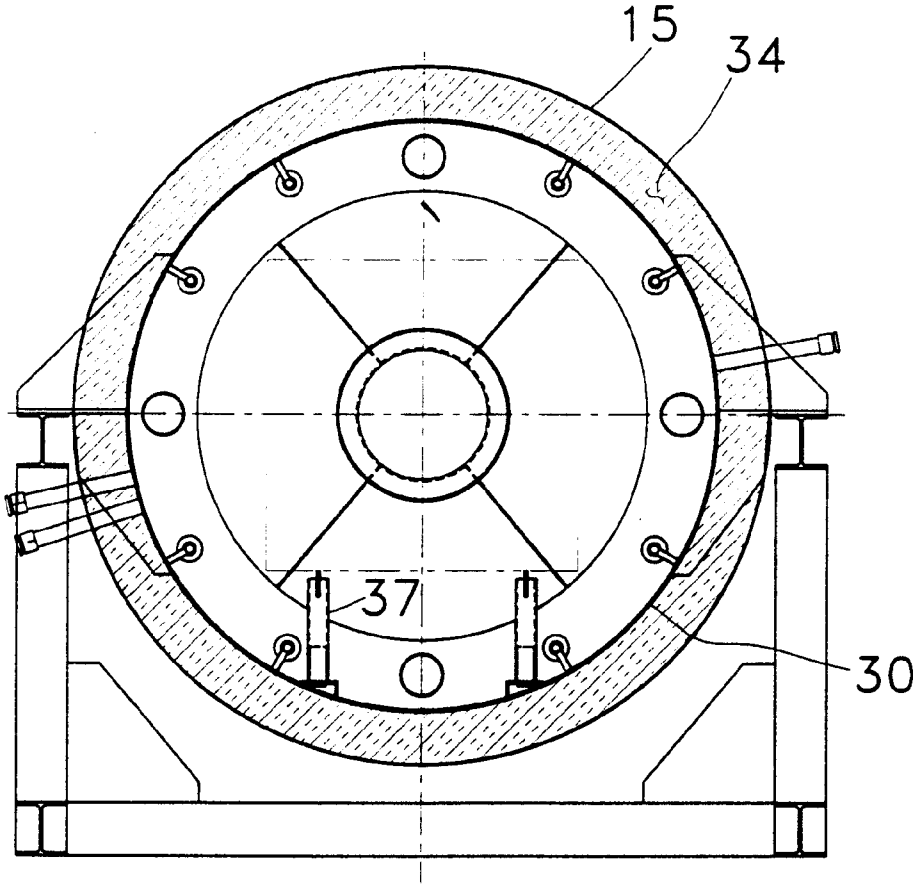
FIG. 4 is a cross sectioned view of the furnace taken generally along the lines 4—4 of the furnace shown in FIG. 1.

As best in shown in FIGS. 2 and 4, furnace 10 has a hearth 36 supported by posts 37 which are directly welded to the inside surface of furnace casing 30. In conventional hot walled positive pressure furnaces, hearth posts 37 extend through the insulation into the furnace chamber and are at a differential temperature. This requires expansion joints which have to have a swivel or a self-centering arrangement to maintain the hearth and load stable within the furnace chamber. Because furnace casing 30 is at the temperature of the furnace, there is no differential expansion and the hearth can be directly secured, as by weldment, to furnace casing 30.

A number of furnace components have to be provided in furnace chamber 32 for furnace 10 to operate. For example, a vacuum port 33 connected to a vacuum pump outside the furnace must be provided. As a point of reference, the VacuDraw furnace pulls a "soft vacuum" at a range of about 50–100 microns which compares to a "hard vacuum" of less than about 0.1 micron capable of being pulled with staged diffusion pumps in conventional double walled vacuum furnaces. Because of the inside/out construction of the present invention, lower vacuum levels of about 10 microns can be pulled. In the preferred embodiment, furnace 10 is indirectly fired through radiant tubes 35 and a furnace atmosphere port 38 connected to a source of furnace treating gas (not shown) is provided. Furnace 10 may also be equipped with a series of cooling tubes 39 as well as a furnace fan 44. All of these are examples of a "furnace component" as used herein.

As thus far described, a furnace could be constructed in accordance with the present invention using water cooled elastomer seals for door 14 and at every place where a furnace component has to extend from the outside into furnace chamber 32. For example, a water cooled door of the type shown and described in the '985 patent, could be used. In accordance with a broad scope of the invention, it is contemplated that water cooled sealing arrangements could be used for some or all of the furnace components extending through furnace casing 30 into furnace chamber 32.

However, waterjackets function as heat sinks. In the prior art hot walled vacuum furnaces, the furnace casing, being on the outside of the furnace, is not exposed to the furnace temperature and any heat sink effects attributed to water jacket cooling of the seals may not materially impact the furnace chamber. Specifically, whatever opening there is in casing which has to be sealed, heat sink effects attributed to the seal and conducted into the casing through the opening in the casing may not adversely affect the furnace because the casing is shielded from the furnace temperature by the insulation. In the present invention, whatever opening is made in furnace casing 30, specifically spherical end plate portion 31, can result in conduction heat transfer from the water cooled seal to the opening in furnace casing 30 and end plate portion 31 which, in turn, promotes cold spots in the furnace adversely affecting temperature uniformity of the work. It is conceivable that a water cooled seal arrangement could be developed for external furnace components that have to be positioned within furnace chamber 32 of the inventive, inside/out vacuum furnace without forming a heat sink promoting cold spots in the furnace casing and to the extent such arrangements are developed, they are believed to fall within the broader concepts of the invention set forth herein. The inventors, as of the date of this invention, have not uncovered such arrangements and have addressed the problem by special seal constructions which allow for use of conventional resilient seals, i.e., elastomeric seals such as conventional rubber silicone seals, to vacuum seal the casing openings through contact with air cooled sealing surfaces which are below the elastomer destructive temperature.

Figure 3:
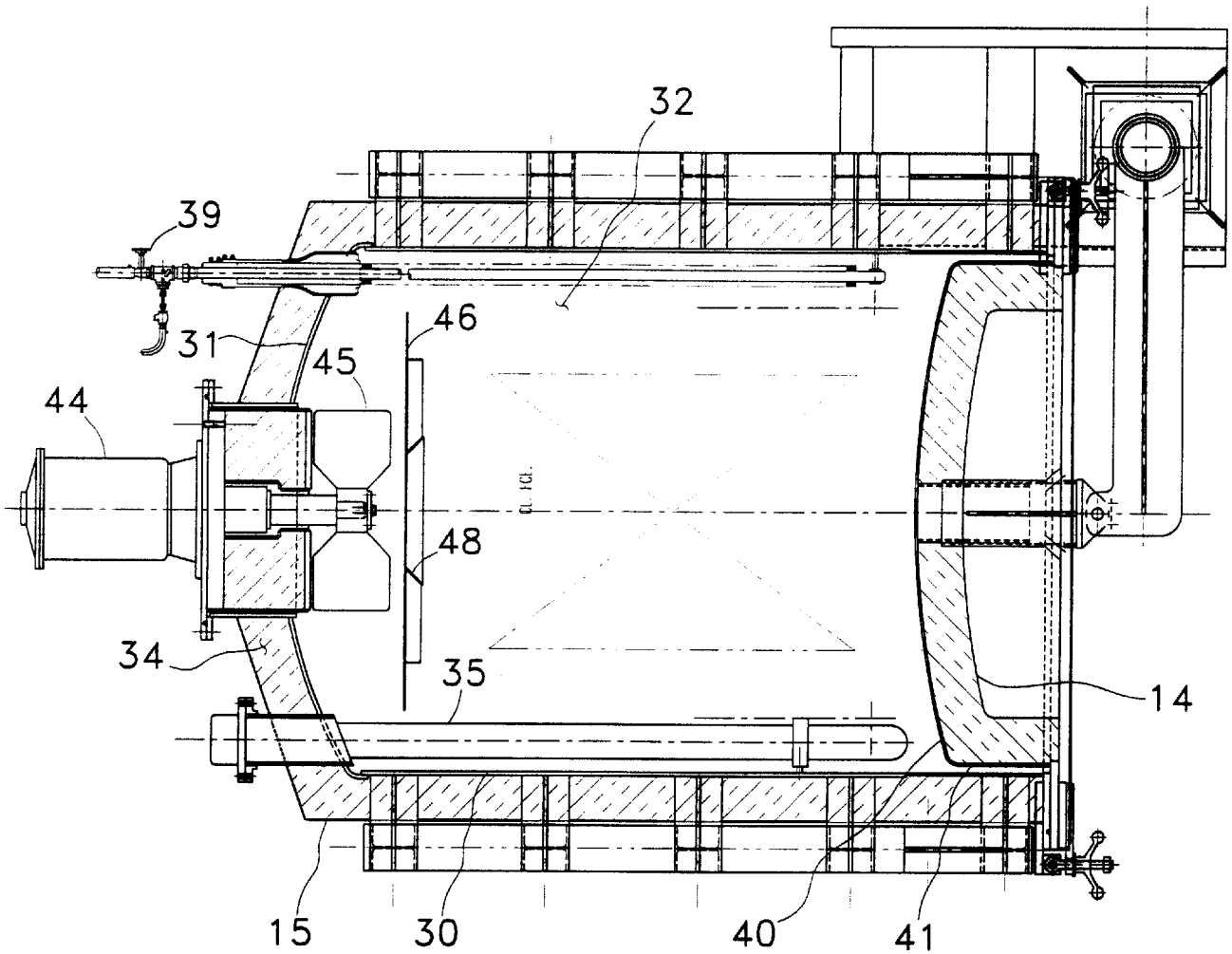
FIG. 3 is a sectioned plan view of the furnace taken along lines 3—3 of the furnace shown in FIG. 1.

Perhaps the most severe sealing requirement is the furnace door. Furnace door 14 in the present invention is especially constructed to allow air or ambient temperature cooling of its seal. Referring to FIGS. 2 and 3, door 14 is shown to have a dished in or concave configuration when looking at furnace 10 from its door end. Door 14 must also have an inside/out construction to provide, like furnace casing 30, an impervious surface to the furnace atmosphere. Door 14 has a spherical or dished circular plate 40 which is vacuum welded at it periphery to a cylindrical door plate 41. When door 14 is closed as shown in FIGS. 2 and 3, cylindrical door plate 41 fits within furnace casing 30 with a small clearance indicated by letter "A" between confronting surfaces of furnace casing 30 and cylindrical door plate 41. Space "A" is the clearance necessary to allow door 14 to fit within furnace casing 30 considering differential thermal expansion contraction between furnace casing 30 and door 14. In furnace 10, the fan 44 develops a special furnace atmosphere wind mass pattern for heating the work on hearth 36. Generally, a fan impeller 45 develops and pushes a wind mass through an annular space existing between a plenum plate 46 and furnace casing 30. This wind mass swirls about furnace casing 30 and travels longitudinally along furnace casing 30 until it impacts door circular plate 40. A central opening 48 in plenum plate 46 acts as an underpressure zone drawing the wind mass back into the fan plenum behind plenum plate 46. Reference should be had to the '091 and the '985 patents for a more complete explanation of how the recirculating wind mass effects convective heat transfer with the work. Because of sizing and geometric configuration of cylindrical door plate 41, there is no significant wind mass flow into and out of clearance space "A" and cylindrical door plate 41 receives little convective heat from the furnace wind mass. Dished door circular plate 40 is convectively heated by the furnace wind mass and that heat passes by conduction through cylindrical door plate 41. As noted, door 14 is a fabrication and dished door end plate 40 is welded to cylindrical door plate 41. A welded joint is inefficient for passing heat by conduction. It may be analogized to a resistor in an electrical circuit.

Figure 6:
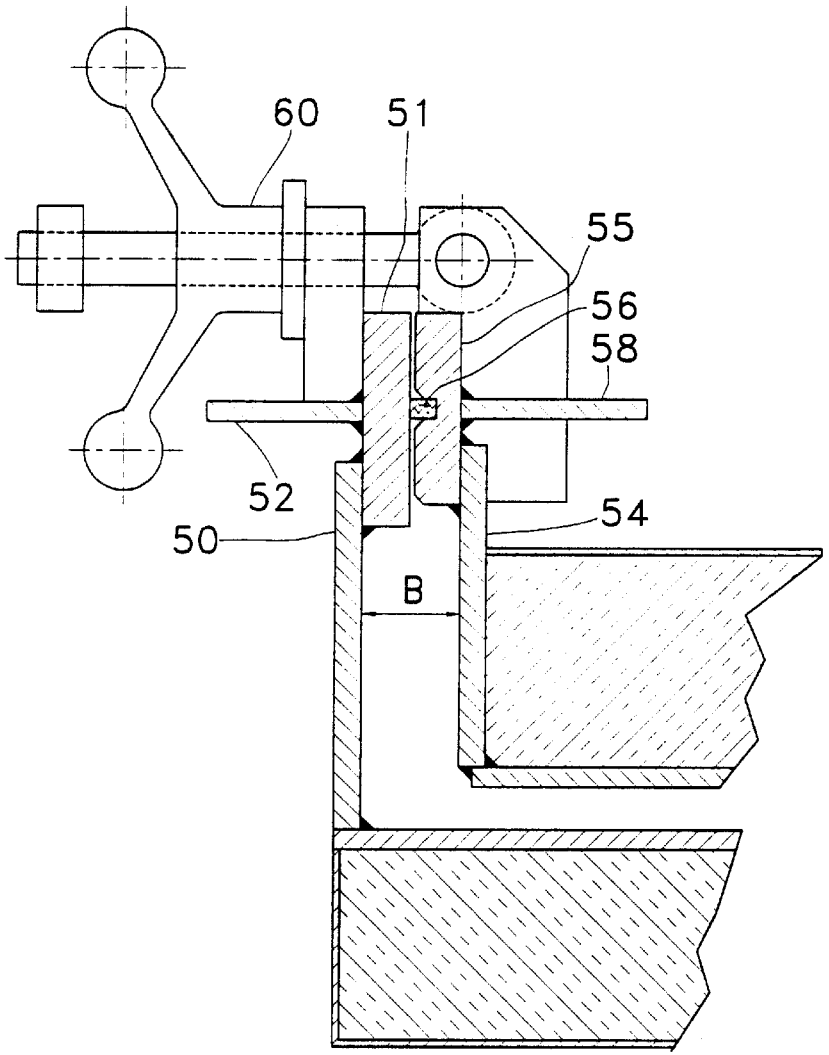
FIG. 6 is a partial sectioned view showing the door sealing arrangement of the present invention.

Referring now to FIG. 6, the opposite end of cylindrical door plate 41 has welded thereto a radially outward extending annular door sealing ring 50 welded to the outside surface of cylindrical door plate 41.. Facing the door opening of furnace casing 30 at the upper portion of door sealing ring 50 is an annular door sealing flange 51 welded to the upper portion door sealing ring 50 at one side thereof. A longitudinally extending door stiffening ring 52 is welded to door sealing flange 51. Door sealing ring 50, sealing flange 51 and stiffening ring 52 are exposed to ambient conditions. A conductive heat path thus starts with convection heat from furnace wind mass inputted to dished door circular plate 40 which is passed through a welded joint to cylindrical door plate 41 which, in turn, passes through a welded joint to first door sealing ring 50 which, in turn, passes through a welded joint to door sealing flange 51 whereat the temperature is insufficient to thermally destroy an elastomer seal such as a siliconized rubber. A similar arrangement is used for the door opening in furnace casing 30. A casing sealing ring 54 is welded to the open end of furnace casing 30 and extends radially outward therefrom past insulation 34. On the surface of casing sealing ring 54 which confronts door sealing ring 50 and at the upper portion of casing sealing ring 54 is vacuum welded an annular, radially outwardly extending casing sealing flange 55 which has a central groove for receiving a rubber silicone door seal 56. A longitudinally extending casing stiffening ring 58 is provided for casing sealing flange 55. The upper portion of casing sealing ring 54, casing sealing flange 55 and casing stiffening ring 58 are exposed to ambient temperature. Breaking the sealing arrangement into annular ring and flanges (50, 51 and 54, 55) with the flanges secured to confronting ring surfaces provides a space, designated by reference letter "B" prevents any conduction heat path formed between casing 30 and door 14. Further, the thickness of the sealing flanges (51, 55) is less than the thickness of sealing rings (50, 54) which are greater than the thickness of door cylindrical plate 41 and furnace casing 30 which increases the resistance to heat conduction in addition to the increase in heat conduction resistance afforded by the weldments. The furnace 10 is a low temperature furnace, in the preferred embodiment operating at temperatures of 800 or 1200° F. The designer dimensions the flanges and ring considering ambient temperatures relative to furnace temperatures and the resistances in the conduction heat path to produce a temperature at the door seal O-ring 56 which will not thermally upset or destroy the ability of O-ring 56 to seal.

Figure 5:
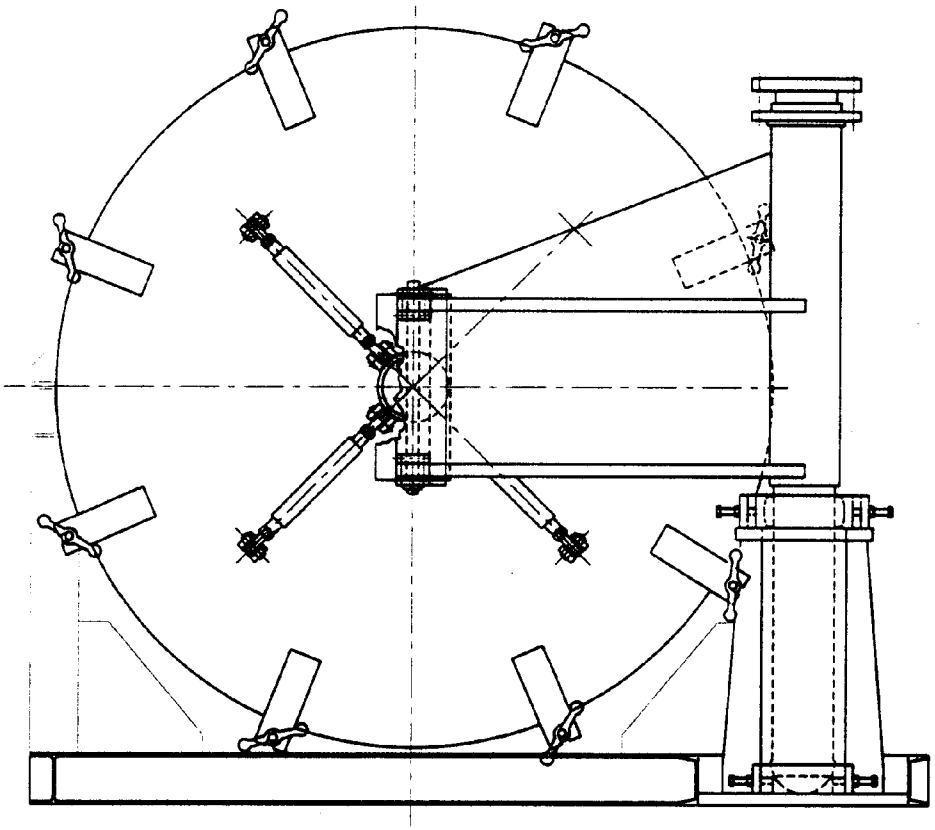
FIG. 5 is an end view of the furnace shown in FIG. 1.

Door sealing flange 51 and casing sealing flange 55 are preferably drawn together by screw clamps 60 (see FIG. 5). While a locking, cam ring arrangement such as produced by the assignee Surface Combustion, Inc. under its Autoclave™ brand name (see the '985 patent ) could be used, differential thermal expansion/contraction between door 14 and furnace casing 30 can occur. The use of screw clamps 60, allow (because of the bolt/slot arrangement in the clamp) for differential thermal expansion while maintaining contact with seal 56 throughout the heating and cooling cycle. In this regard, it is to be noted that furnace chamber is alternately at vacuum and positive pressures and at different temperatures within the cycle. Under vacuum no clamp is needed. Relative shifts in position of door and casing can occur during pressure transitions accompanied by temperature changes. The bolt/slot arrangement of the manual clamp allows for differential movement between door 14 and casing 30.

Figure 12:
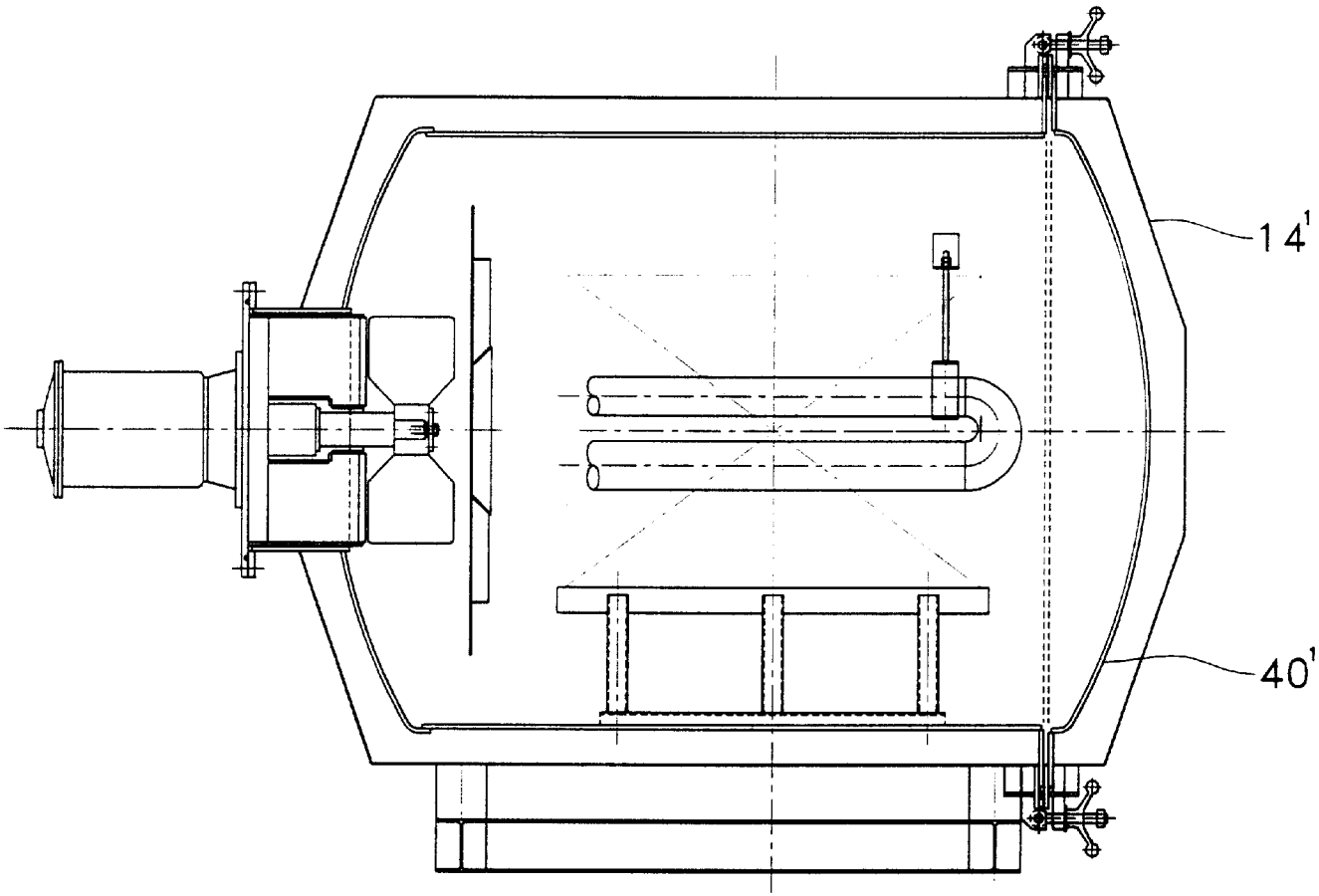

As noted, inside/out vacuum furnace 10 has specific applications for low temperature heat processes occurring in the range of 800° F. to 1200° F. and conceivably within a low temperature range of 800° F. to 1450° F. Within this range, certain heat processes are normally performed at 800° F. while other processes require temperatures of 1200° F. and conceivably "low" furnace temperatures as high as 1450° F. In fact, the low temperature vacuum furnaces may be marketed as a "low" low temperature vacuum furnace, i.e., up to about 800° F. to 900° F. and a "high" low temperature vacuum furnace, i.e., up to about 1200° F. to 1450° F. There is a significant difference in air cooling an elastomer door seal at 800° F. and air cooling an elastomer door seal when the furnace is at 1200° F. Specifically, it has been determined that for a furnace 10 operating at a maximum temperature of about 800° F., a door 14' as shown in FIG. 12, which has a dished out or convex configuration when viewing furnace 10 from its door end can be employed. Door 14' does not need and does not have cylindrical door plate 41 as shown and described above in FIGS. 2 and 3 for door 14. Door 14' has an inside/out construction with insulation applied (not shown in FIG. 12 for drawing clarity) to the outside surface of dished circulate plate 4– which presents an impervious surface to the furnace atmosphere. The elastomer door sealing arrangement shown in FIG. 6 and described above for the "high" temperature (1200–1450° F.) door 14 is also used for "low" temperature (800° F.) door 14' shown in FIG. 12 and will not be repeated.

As noted above, extending into furnace chamber 32 are any number of furnace components which perform a furnace function and which are powered or supplied by a source external to furnace 10 and "furnace component" as used in this description and in the claims has this meaning. For example, fan 44 provides the furnace function of circulating a wind mass and is powered by an external electrical power supply. Each furnace component must extend through and be vacuum sealed with furnace casing 30. In general, a similar sealing arrangement is used to effect vacuum sealing of the furnace components without having to resort to a water jacket cooling seal arrangement. Generally, an opening is provided in furnace casing 30 (including its spherical end plate portion 31) and vacuum sealed to this opening is a projection tube which tube is surrounded and insulated by furnace insulation 34. The projection tube has a projection sealing flange extending therefrom at a position outside and spaced away from furnace insulation 34. The furnace component extends through the projection tube into furnace chamber 32 and has affixed thereto in a vacuum tight manner, a component sealing flange adapted to abut against the projection sealing flange when the furnace component is inserted into furnace chamber 32. Both flanges, being outside and away from the furnace and the projection tube being insulated by the furnace insulation, are at temperatures whereat a resilient elastomer seal can be employed between the flanges without thermal destruction to seal the furnace component to furnace casing 30.

Figure 7:
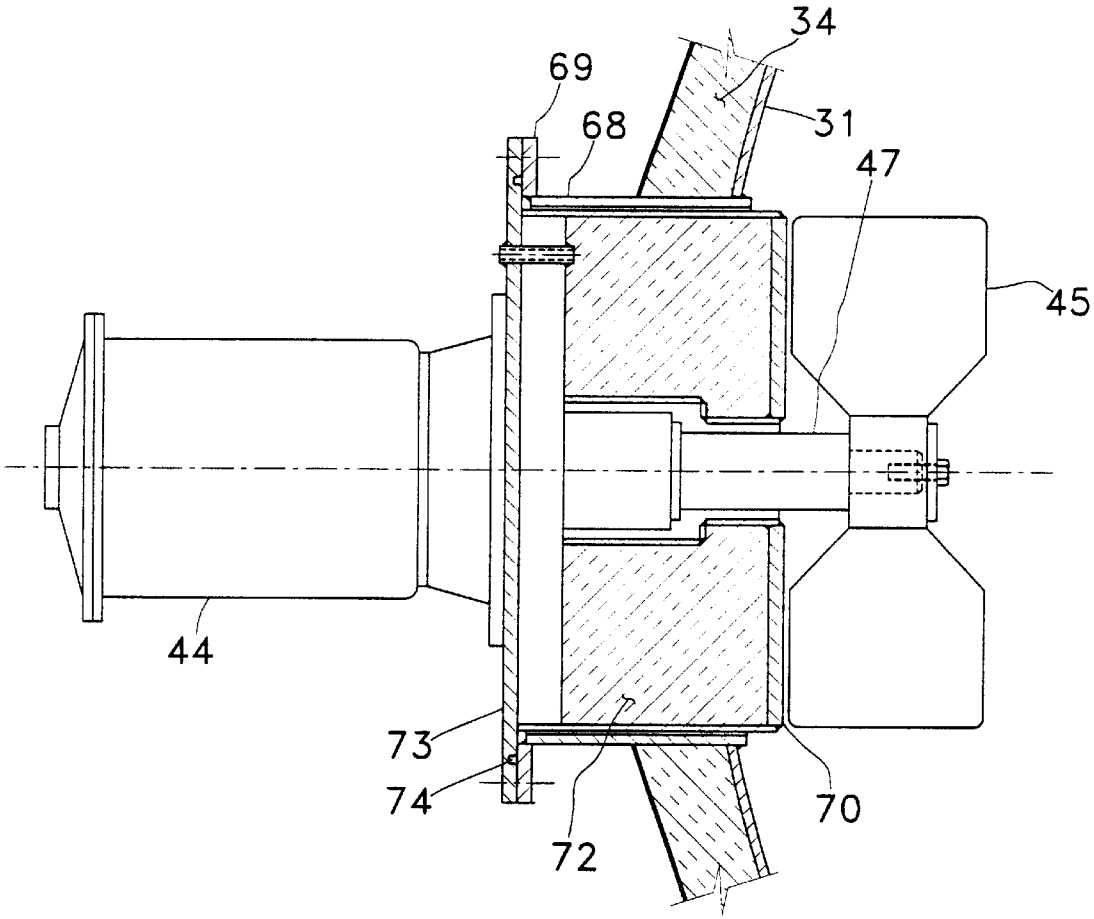
FIG. 7 is a partial sectioned view showing the fan bung sealing arrangement of the subject invention.

Referring now to FIG. 7, there is shown a sealing arrangement for furnace fan 44. In this arrangement, a furnace fan projection tube 68 is sealed by a vacuum weldment to spherical end plate portion 31 of furnace casing 30 and extends through furnace insulation 34 which acts to insulate the furnace fan projection tube 68. At the end of furnace fan projection tube 68, spaced from and outside of furnace insulation 34, is an annular projection sealing flange 69 which is welded vacuum tight to fan projection tube 68. Note that projection sealing flange 69 is not welded flush to the outside end of fan projection tube 68 but is offset therefrom to reduce the heat conduction path to projection sealing flange 69. This construction is used throughout. Fan impeller 45 is secured to a fan shaft 47 which extends through a tubular fan bung 70 which slides inside furnace fan projection tube 68. Fan bung 70 also has insulation as depicted by reference numeral 72 and has a bung sealing flange 73. Bung sealing flange 73 carries a fan sealing O-ring 74 which is sealing compressed when bung sealing flange 73 is secured to fan projection sealing flange 69.

Figure 8:
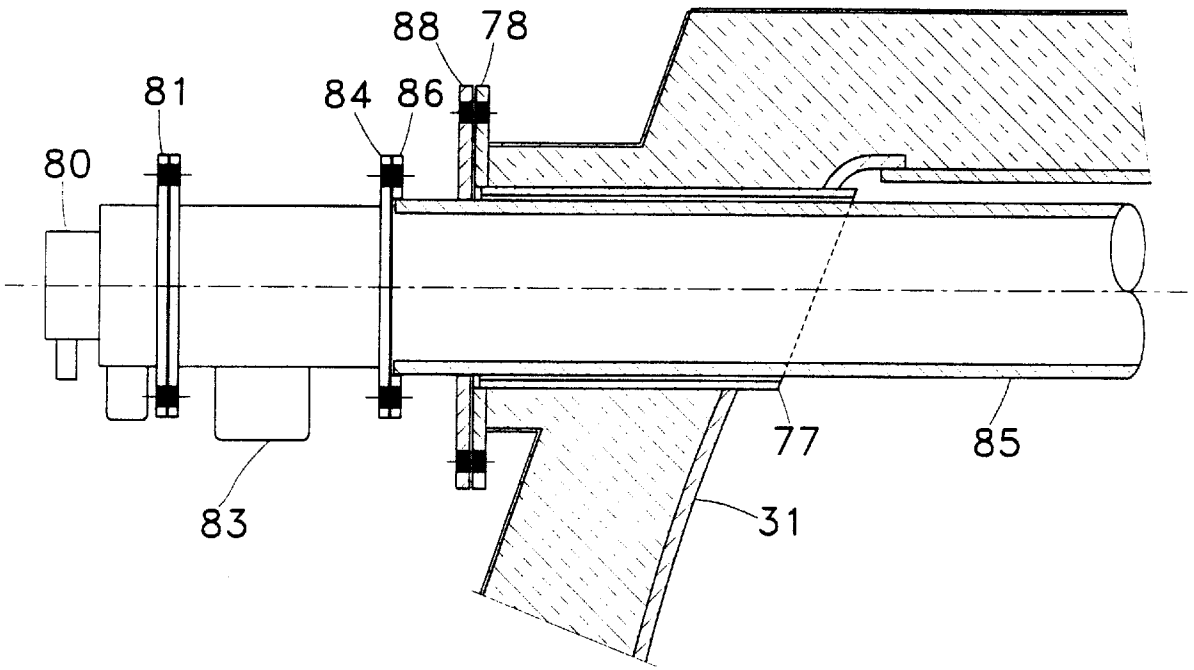
FIG. 8 is a partial sectioned view of the furnace construction showing the sealing arrangement for a single ended radiant tube.

Referring now to FIG. 8, there is shown a single ended radiant tube sealing arrangement. A radiant tubular projection 77 is vacuum welded to furnace casing 30 at its spherical end portion 31 and an offset radiant projection sealing flange 78 is vacuum welded to the end of radiant tubular projection 77 in a manner similar to that described for the fan seal. A single ended radiant tube, as is well known, is a tube within a tube in that a burner fires its products of combustion down a central tube which impacts a closed end of an outer tube and travels back in the annulus formed between the firing tube and the outside tube to an exhaust. In FIG. 8, the burner and firing tube designated by reference numeral 80 is sealed by flange connection 81 to an exhaust section 83 which, in turn, is sealed by a second flange connection 84 integrally secured to the outer, return tube 85 of the radiant tube. Flange 86 and flange 88 are both welded (vacuum tight) to return tube 85. They are secured to flanges 84 and 78, respectively, by elastomer seals.

Figure 9:
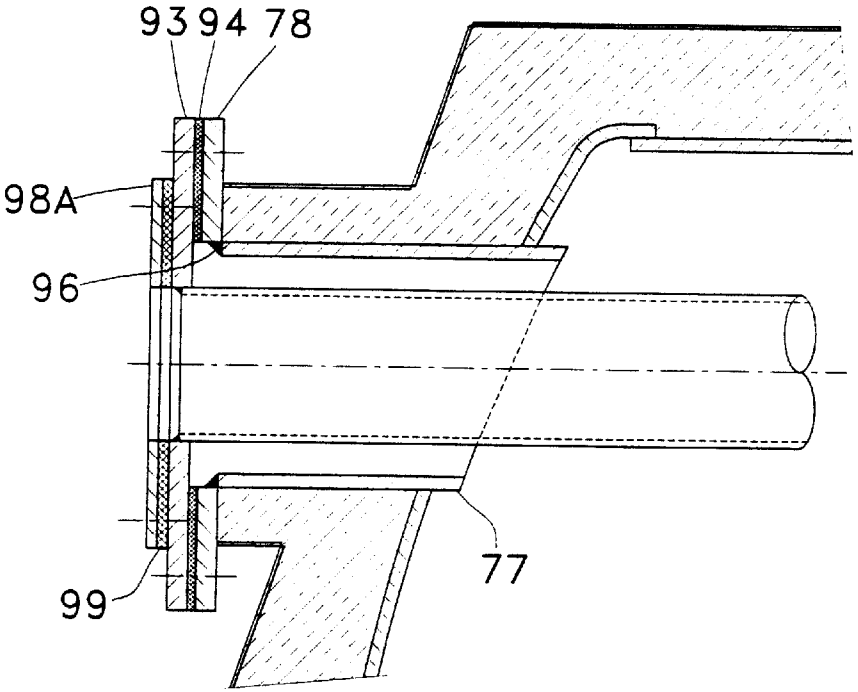
FIG. 9 is a partial sectioned view showing a sealing arrangement for a U-shaped radiant tube.
Figure 10:
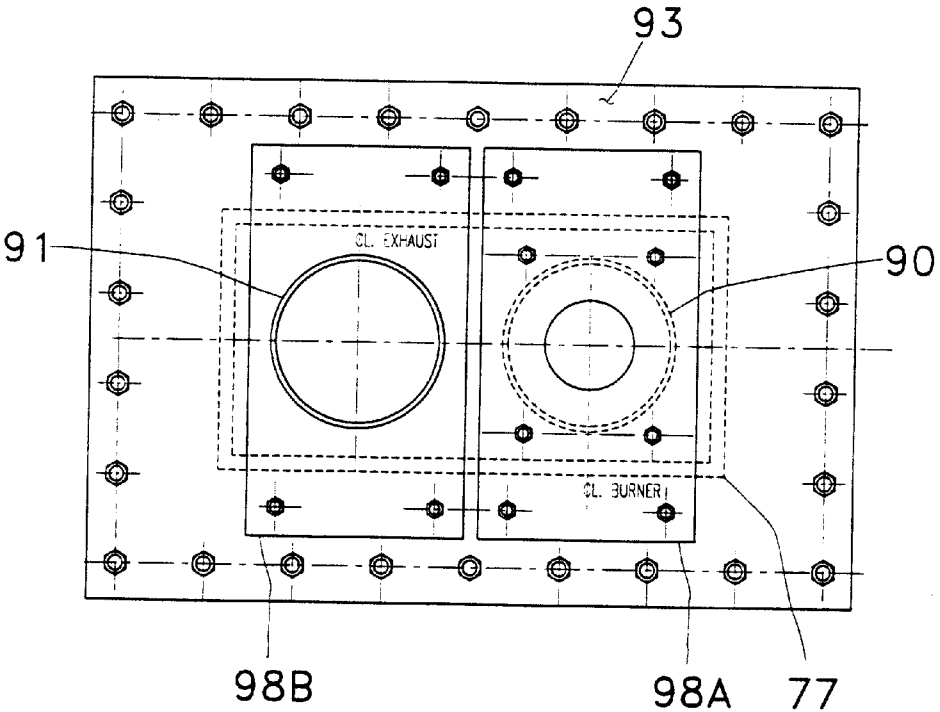
FIG. 10 is an end view of the bulk head arrangement used to secure the U-shaped radiant tube to the furnace shown in FIG. 10.

Referring now to FIGS. 9 and 10, there is shown a sealing arrangement for a double ended, U-shaped radiant tube having a firing leg 90 and a return leg 91, the exits of which are best shown in FIG. 10. In this embodiment, radiant tubular projection 77 is rectangular in shape and radiant projection sealing flange 78 is also rectangular in configuration. A first rectangular bulkhead 93 when fastened to radiant projection sealing flange 78 compresses a resilient seal 94 therebetween. At the center of first bulkhead 93 are two cylindrical openings which are vacuum sealed to the ends of firing and return legs 90, 91 of the double ended radiant tube. The vacuum attachment is shown by the offset weld discussed with reference to the fan bung and indicated by the weldment designated by reference numeral 96 in FIG. 9. Two second bulkheads 98, namely a burner bulkhead 98A and a return leg bulkhead 98B are mounted on the opposite surface of first bulkhead 93 to compress a bulkhead seal 99 therebetween. Normally, a double ended radiant tube is conventionally mounted to allow one of its legs to freely move to accommodate thermal expansion/contraction. In the arrangement illustrated in FIGS. 9 and 10, first and second bulkheads 93, 98 use an air cooled seal arrangement which fixes both firing and return legs 90, 91 of the double ended radiant tube against movement. Thermal expansion and contraction will take place at the bite portion of the U-shaped radiant tube and will not adversely impact the functioning of the tube nor will the life of the tube be materially impacted because of the low temperatures at which the furnaces in the preferred embodiment are operated. It is recognized that, depending on application, furnace 10 may be equipped with either single ended or double ended radiant tubes since each have advantages and disadvantages. FIGS. 8–10 show that either type of radiant tube can be effectively sealed.

Figure 11:
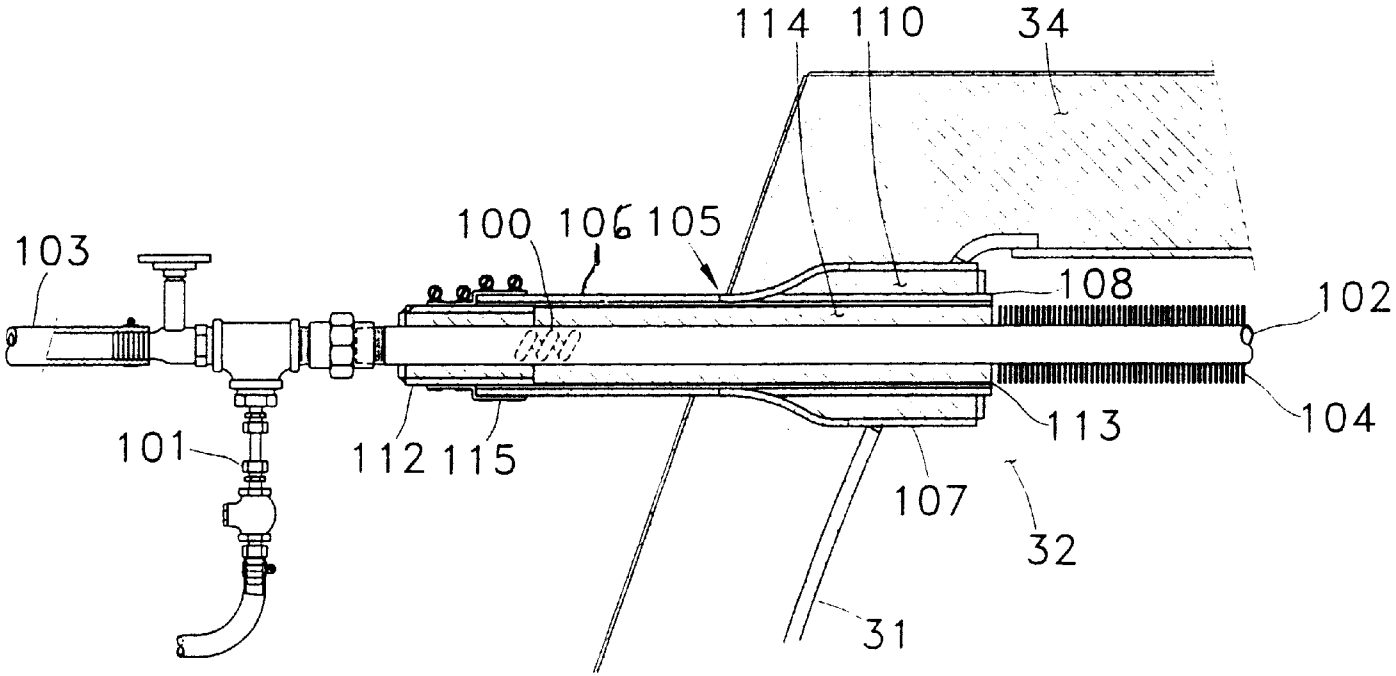
FIG. 11 is a partial sectioned view showing the sealing arrangement for a cooling tube; and, FIG. 12 is a longitudinal sectioned view of the furnace without insulation, similar to FIG. 2, illustrating a door construction for use in vacuum furnaces operating at the lower temperature range.

Referring now to FIG. 11, there is shown a seal arrangement for a liquid supply cooling tube(s) inserted into furnace chamber 32 such as cooling tubes of the type sold by assignee under its brand name Intra-Kool®. In this arrangement, a coiled tube 100 secured to a water supply 101 extends within a pipe 102 into furnace chamber 32. The water exits coil tube 100 at its end and travels back through pipe 102 (end of pipe 102 and tube 100 not shown) to a water drain 103. Cooling fins 104 emanating from pipe 102 provide a cooling area for heat transfer when the work is to be cooled. Cooling projection 105 has a cylindrical outside portion 106 and a bulb shaped cylindrically flared internal portion 107 which is vacuum welded to spherical portion 31 furnace casing 30. A cylindrical internal portion 108, having the same or similar diameter as cylindrical outside portion 106, is welded to outside portion 106 to define an annular projection insulation space 110 into which high density, ceramic fibrous insulation is packed. A cup shaped collar 112 is vacuum welded at the base of its cup to pipe 102 outside furnace 1 0. Tubular shaped insulation 114 surrounding pipe 102 extends radially to but at a slight clearance from cylindrical outside and internal portions 106, 108 (or alternatively, in contact therewith) and longitudinally extends to the axial end of internal portion 108 designated by reference numeral 113. The annular space between pipe 102 and collar 1 12 is similarly packed with high density ceramic insulation. A clamp 115 containing a rubberized inner surface clamps the outside surface of collar 112 to the outside edge surface of cooling projection 105 (i.e., the exposed end portion of outside cylindrical portion 106) to effect a vacuum seal between cooling projection 105 and collar 112. As noted, the seal for the cooling tubes is, perhaps, outside of the door, the most difficult to effect. It is appreciated that the tubes are empty during heating so that the tube is approximately the same temperature as the furnace. At the start of the cooling cycle, water starts flowing through the tube rapidly lowering the temperature. The metal surrounding the cooling tube will also cool very quickly while the metal a short distance away will still be at furnace temperature. This produces thermal shock and thermal stress of the metal requiring compensation by an oversized insulated assembly. The door seal was described as the most severe application for sealing. This is essentially because of the size of the area to be sealed with the very real possibility of leaks or localized failures occurring about the door circumference for any number of reasons. In contrast, cooling tubes provide the most severe sealing condition in terms of thermal shock or stress resulting from introduction of a liquid coolant into a heated chamber.

The furnace of the present invention is specifically designed for use at low heating applications of about 800° F. and about 1200° F. (conceivably as high as 1450° F.) where it's low cost makes it competitive with other conventional draw or temper furnaces but with additional features making it an attractive alternative. As discussed in the Background, the fact that the furnace atmosphere is exposed to an impervious metal liner 30, protects the works from contaminates (such as water vapor) that can otherwise be absorbed in the refractory or insulation of the furnace. While the furnace, at its low temperature application, does not pull a vacuum during heating of the work, the furnace does have a vacuum purge which can purge furnace chamber 32 with the work cold and/or with the work hot, after heating. Since the furnace is a batch type, the door is open and furnace chamber 32 is full with air at the start of each run. Direct fired batch furnaces are purged with the burner flue products. Other, indirect fire furnace are purged by dilution. That is, oxygen free gas flows into the heating chamber displacing the air. For indirect fired prior art furnaces, five furnace volume changes are used to reduce the oxygen level below 4% . With vacuum purging, the air is pumped from the heating chamber and then it is backfilled with $N_2$ or $N_2$ and $H_2$. The purged gas volume is now only one furnace volume and the residual oxygen is usually in the ppm levels which is much lower than that which can be attained by dilution as explained. The fact that the furnace can operate with a vacuum purge, allows for hot pump down after convection heating makes the furnace especially well suited for performing several heat processes. It is especially useful for thermal cleaning and heat treating where it is desirable to change the atmosphere after the work is heated. A typical example would be tempering a dirty part. Hot pump down removes the contaminates (dirt, oils, etc.) preventing them from recontaminating the work when the work is cooled. The furnace is especially suited for this process because the work is indirectly fired vis-a-vis the radiant tube designs disclosed in FIGS. 8–10. However, radiant tubes heretofore have been water cooled when used in the vacuum furnaces under discussion. It is also to be appreciated that the furnace has total containment to control release of the furnace gases to the surrounding areas. Examples of where this is important include:

i) Nitriding with ammonia. The inside/out design reduces the amount of ammonia required for nitriding and the vacuum prevents the ammonia from escaping into the room. However, with a nitriding application, a different alloy casing impervious to isocyanate and cyanuric acid resulting from ammonia dissemination is required.

ii) Treating oily parts because the indirect firing does not produce as much smoke as that from a direct fired application and a vacuum purge removes the smoke with little leakage. The inside/out construction prevents contamination of the insulation or the refractory so that the furnace can also be used for heat treat cycles such as bright annealing.

iii) Cleaning components that have toxic substance that cannot escape to the atmosphere or leech into the insulation. For example, applications such as removal of mercury from metal components which produce mercury vapors.

The invention has been described with reference to a preferred embodiment. Obviously, modifications and alterations will occur to those skilled in the art upon reading and understanding the Detailed Description of the Invention. It is intended to include all such modifications and alterations insofar as they come within the scope of the present invention.

Having thus defined the invention, it is claimed:

1. In an industrial batch, vacuum furnace having a furnace chamber defined by a furnace casing, a sealable door for loading work into and out of the furnace chamber, a fan extending through the casing for circulating furnace atmosphere within the chamber during a heat cycle, heater means within the chamber for heating work within the chamber, and ports within the casing for drawing a vacuum within the chamber and backfilling a heat treat atmosphere to the chamber, the improvement comprising:

furnace insulation applied to the outside surface of the furnace casing while the inside surface of the casing sealed gas tight defines a gas impervious surface of the furnace chamber exposed to the furnace atmosphere, whereby the furnace chamber can not be penetrated by furnace atmosphere gases used in the heat process.

2. The furnace of claim 1 wherein said furnace casing is cylindrical and has an open door end and an opposite closed spherical end; said door having a dished in, concave configuration extending into said open end of said casing defined by a circular door section having at its circumference a cylindrical door section and an annular door sealing flange extending radially outward from the end of said cylindrical door section adapted to contact a resilient seal, said circular and cylindrical door plate sections having outer surfaces facing the furnace casing and inner surfaces having furnace insulation attached thereto, so that when the door is closed the circular and cylindrical door sections are within the furnace chamber closely circumscribed by the furnace casing to provide a sufficiently long heat path to maintain the door sealing flange relatively cool only by exposure of said furnace insulation to ambient air.

3. The improvement of claim 2 wherein said furnace casing at its open end has an annular sealing flange extending radially outwardly in confronting relationship to said door sealing flange; said resilient seal being an elastomer seal in one of the door and furnace casing sealing flanges, said door sealing flange having an elastomer seal section thicker than said door section surfaces facing said furnace casing and a door tightening mechanism for drawing the door and furnace casing sealing flanges together to compress the elastomer seal when the door is closed.

4. The improvement of claim 1 further including framework attached to ground supporting said casing and said door has a pivot arm with a first pivot attached to said door and a second pivot attached to said framework whereby the door is fixed relative to the ground while it rotates and axially moves into and out of engagement with the open end of the furnace chamber so that the furnace casing may thermally expand and contract without binding the door or the door operating mechanism.

5. The improvement of claim 1 wherein said casing has at least one opening, a projection contiguous with said casing about said one opening and extending from said opening past said insulation, said projection having a projection flange at its end outside said insulation; an insertion object to be inserted into said furnace chamber and connected to a supply outside said furnace; an object sealing flange secured vacuum tight to said object and sealing secured to said projection flange outside and away from said casing whereby elastomers may be used to vacuum seal said insertion object without furnace heat adversely effecting the sealing ability of said elastomers.

6. The improvement of claim 5 wherein said insertion object is a single ended radiant tube.

7. In an industrial batch, vacuum furnace having a furnace chamber defined by a furnace casing, a sealable door for loading work into and out of the furnace chamber, a fan extending through the casing for circulating furnace atmosphere within the chamber during a heat cycle, heater means within the chamber for heating work within the chamber, and ports within the casing for drawing a vacuum within the chamber and backfilling a heat treat atmosphere to the chamber, the improvement comprising:

furnace insulation applied to the outside surface of the furnace casing while the inside surface of the casing defining the surface of the furnace chamber is exposed to the furnace atmosphere, whereby the furnace chamber is impervious to furnace atmosphere gases used in the heat process, and said casing is suspended at its side by brackets to a support framework secured to ground, said brackets being secured to said framework on a line approximately parallel with the longitudinal centerline of the casing whereby said casing can freely expand and contract in response to temperature changes within the furnace.

8. In an industrial batch, vacuum furnace having a furnace chamber defined by a furnace casing, a sealable door for loading work into and out of the furnace chamber, a fan extending through the casing for circulating furnace atmosphere within the chamber during a heat cycle, heater means within the chamber for heating work within the chamber, and ports within the casing for drawing a vacuum within the chamber and backfilling a heat treat atmosphere to the chamber, the improvement comprising:

furnace insulation applied to the outside surface of the furnace casing while the inside surface of the casing defining the surface of the furnace chamber is exposed to the furnace atmosphere, whereby the furnace chamber is impervious to furnace atmosphere gases used in the heat process;

said casing having at least one opening, a projection contiguous with said casing about said one opening and extending from said opening past the insulation, said projection having a projection flange at its end outside the casing insulation; an insertion object to be inserted into the furnace chamber and connected to a supply outside the furnace; an object sealing flange secured vacuum tight to said object and sealing secured to said projection flange outside and away from said casing whereby elastomers may be used to vacuum seal the insertion object without furnace heat adversely effecting the seal; and, said insertion object being a water cooled fan inserted at the closed end of the furnace casing; said fan having a fan blade and shaft extending into said furnace housing, a water cooled fan motor outside said casing and a sealing flange extending radially outward from said fan motor; said projection forming an insulated jacket surrounding said fan shaft, and an elastomer seal between said projection flange and said motor's sealing flange.

9. In an industrial batch, vacuum furnace having a furnace chamber defined by a furnace casing, a sealable door for loading work into and out of the furnace chamber, a fan extending through the casing for circulating furnace atmosphere within the chamber during a heat cycle, heater means within the chamber for heating work within the chamber, and ports within the casing for drawing a vacuum within the chamber and backfilling a heat treat atmosphere to the chamber, the improvement comprising:

furnace insulation applied to the outside surface of the furnace casing while the inside surface of the casing defining the surface of the furnace chamber is exposed to the furnace atmosphere, whereby the furnace chamber is impervious to furnace atmosphere gases used in the heat process;

said casing having at least one opening, a projection contiguous with said casing about said one opening and extending from said opening past the insulation, said projection having a projection flange at its end outside the casing insulation; an insertion object to be inserted into the furnace chamber and connected to a supply outside the furnace; an object sealing flange secured vacuum tight to said object and sealing secured to said projection flange outside and away from said casing whereby elastomers may be used to vacuum seal the insertion object without furnace heat adversely effecting the seal; and, said insertion object is a U-shaped radiant tube having a firing leg and an exhaust leg, said sealing flange for the radiant tube including a first bulkhead sealing secured to said projection flange and a second bulkhead sealing secured to said first bulkhead whereby both firing and exhaust legs are restrained by the bulkheads from thermally expanding or contracting in a longitudinal direction outside the furnace chamber.

10. In an industrial batch, vacuum furnace having a furnace chamber defined by a furnace casing, a sealable door for loading work into and out of the furnace chamber, a fan extending through the casing for circulating furnace atmosphere within the chamber during a heat cycle, heater means within the chamber for heating work within the chamber, and ports within the casing for drawing a vacuum within the chamber and backfilling a heat treat atmosphere to the chamber, the improvement comprising:

furnace insulation applied to the outside surface of the furnace casing while the inside surface of the casing defining the surface of the furnace chamber is exposed to the furnace atmosphere, whereby the furnace chamber is impervious to furnace atmosphere gases used in the heat process;

said casing having at least one opening, a projection contiguous with said casing about said one opening and extending from said opening past the insulation, said projection having a projection flange at its end outside the casing insulation; an insertion object to be inserted into the furnace chamber and connected to a supply outside the furnace; an object sealing flange secured vacuum tight to said object and sealing secured to said projection flange outside and away from said casing whereby elastomers may be used to vacuum seal the insertion object without furnace heat adversely effecting the seal; and, said insertion object is a cooling tube including a coiled tube containing a coolant within a pipe threadingly connected to a coolant supply extending into said furnace chamber; said projection having an outer plate sealed to an opening in said furnace casing at the closed end of said furnace chamber and a concentric tubular, radially inward plate extending within said insulation and secured to said outer plate with insulation therebetween; an insulating tube containing and sealed to the pipe outside said furnace chamber and extending within said projection's tubular plate; and a clamp securing said projection's outer plate to said insulating tube outside said furnace.

11. A low temperature, industrial vacuum furnace operating at temperatures not exceeding about 1200 to 1400° F. comprising:

a cylindrical, gas tight casing closed at one end and open at its opposite end;

a door for closing the open end of the casing;

a vacuum port in said casing connected to a vacuum pump for pulling a vacuum;

a fan for circulation furnace atmosphere;

a radiant tube for indirectly heating the work; and, furnace insulation only on the outside of said casing and said door whereby the interior of the furnace is impervious to atmospheric gases and liquid substances within the furnace.

12. The furnace of claim 11 wherein at least one of said door, said vacuum part, said fan and said radiant tube are vacuum sealed to said casing by air cooled elastomer seals positioned outside of said furnace and spaced away from said furnace insulation.

13. A low temperature, industrial vacuum furnace comprising:

a cylindrical casing closed at one end and open at its opposite end;

a door for closing the open end of the casing;

a vacuum port in said casing connected to a vacuum pump for pulling a vacuum;

a fan for circulation furnace atmosphere;

a radiant tube for indirectly heating the work;

furnace insulation only on the outside of said casing and said door whereby the interior of the furnace is impervious to atmospheric gases and liquid substances within the furnace; and, wherein said door, said vacuum port, said fan and said radiant tube are all sealed by air cooled elastomer seals positioned outside of said furnace and spaced away from said furnace insulation.

14. The furnace of claim 13 wherein said low temperatures which said furnace operates at do not exceed about 1200° F. to 1450° F.

15. The furnace of claim 14 wherein said door is mounted independently of and without attachment to said casing, and said casing is supported by two structural members longitudinally extending parallel to the longitudinal centerline of the casing, each structural member positioned diametrically opposite the other and secured by framework to ground and said door being secured to said framework.

* * * * *